US007025570B2

(12) United States Patent
Jung et al.

(10) Patent No.: US 7,025,570 B2
(45) Date of Patent: Apr. 11, 2006

(54) AXIAL FLOW FAN ASSEMBLY

(75) Inventors: Sang Gyu Jung, Kwangju (KR); Jae Man Joo, Suwon (KR); Seung Bae Lee, Inchon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 80 days.

(21) Appl. No.: 10/747,175

(22) Filed: Dec. 30, 2003

(65) Prior Publication Data

US 2004/0191061 A1 Sep. 30, 2004

(30) Foreign Application Priority Data

Mar. 28, 2003 (KR) ..... 10-2003-0019470
Mar. 29, 2003 (KR) ..... 10-2003-0019797

(51) Int. Cl.
*F01D 5/22* (2006.01)

(52) U.S. Cl. ..... 416/192; 416/500; 416/144

(58) Field of Classification Search ..... 416/182, 416/185, 189, 192, 244 R, 500, 144, 194
See application file for complete search history.

(56) References Cited

U.S. PATENT DOCUMENTS 4,548,548 A * 10/1985 Gray, III ..... 416/189
5,244,347 A * 9/1993 Gallivan et al. ..... 416/189
6,027,307 A * 2/2000 Cho et al. ..... 415/173.5
6,241,474 B1 6/2001 Alizadeh et al.
6,302,650 B1 * 10/2001 Williams et al. ..... 416/144

FOREIGN PATENT DOCUMENTS

| | | |
|---|---|---|
| EP | 933 534 A2 | 8/1999 |
| EP | 933 534 A3 | 1/2001 |
| JP | 2002-276598 | 3/2001 |
| WO | 2/38962 A2 | 5/2002 |
| WO | 2/38962 A3 | 5/2002 |

* cited by examiner

*Primary Examiner*—Edward K. Look
*Assistant Examiner*—Dwayne J White
(74) *Attorney, Agent, or Firm*—Staas & Halsey LLP

(57) ABSTRACT

An axial flow fan assembly is provided to prevent the backflow of fluid passing therethrough. The axial flow fan assembly includes a mounting panel having a through-hole to allow fluid flow, and an axial flow fan having a plurality of fan blades rotatably installed in the through-hole of the mounting panel to generate a suction force. A fan shroud connects outer ends of the plurality of fan blades to each other to guide the fluid flowing by the suction force, and includes a flange outwardly extended from the fan shroud to diminish the backflow of the fluid through a gap between the fan shroud and the through-hole of the mounting panel.

16 Claims, 4 Drawing Sheets

AXIAL FLOW FAN ASSEMBLY

CROSS-REFERENCE TO RELATED APPLICATION

This application claims the benefit of Korean Application No. 2003-19797, filed Mar. 29, 2003, in the Korean Intellectual Property Office, the disclosure of which is incorporated herein by reference, and Korean Application No. 2003-19470, filed Mar. 28, 2003, in the Korean Intellectual Property Office, the disclosure of which is incorporated herein by reference.

BACKGROUND OF THE INVENTION

1. Field of the Invention

The present invention relates to an axial flow fan assembly, and, more particularly, to an axial flow fan assembly, which is designed to prevent the backflow of air and the deterioration of blowing efficiency due to the backflow.

2. Description of the Related Art

Generally, an axial flow fan assembly is adapted to be rotated by the rotating force of a drive motor, to cause fluid, such as air, to flow axially. The axial flow fan assembly includes a drive motor to generate a rotating force, an axial flow fan, which has a plurality of fan blades that are rotated by the rotating force from the drive motor to cause fluid, such as air, to flow axially. A typical axial flow fan assembly also has a mounting panel to rotatably support the axial flow fan and includes a through-hole to allow air to flow therethrough.

In the conventional axial flow fan assembly, a suction force, generated by the axial flow fan, drives air current not only in a forward direction, but also in a rearward direction of the axial flow fan through a gap defined between outer ends of the fan blades and the through-hole. Accordingly, there is a problem in that the blowing efficiency of the axial flow fan is decreased because air located in the front of the axial flow fan flows backward through the gap defined between the fan blades and the mounting panel.

In addition, because the amount of vibration of the axial flow fan may vary depending on the material or size of the axial flow fan abnormal vibration and noise are generated when the axial flow fan is rotated while mounted on a drive motor. This occurs even when the axial flow fan is manufactured into the same shape in accordance with a single design.

SUMMARY OF THE INVENTION

Accordingly, it is an aspect of the present invention to provide an axial flow fan assembly, which is designed to reduce backflow of air due to the flow through a gap defined between an axial flow fan and a through-hole of a mounting panel.

It is another aspect of the present invention to provide an axial flow fan assembly, which is adapted to easily reduce vibration due to rotation of an axial flow fan.

Additional aspects and/or advantages of the invention will be set forth in part in the description which follows and, in part, will be obvious from the description, or may be learned by practice of the invention.

The above and/or other aspects are achieved by providing an axial flow fan assembly comprising a mounting panel having a through-hole to allow fluid to flow therethrough, and an axial flow fan including a plurality of fan blades rotatably installed in the through-hole of the mounting panel to generate a suction force, a fan shroud connecting outer ends of the plurality of fan blades to each other to guide the fluid flowing by the suction force, and a flange outwardly extended from the fan shroud to diminish the backflow of the fluid through a gap between the fan shroud and the through-hole of the mounting panel.

In an aspect of the invention, the flange has a diameter larger than that of the through-hole of the mounting panel to block the gap between the fan shroud and the through-hole of the mounting panel, and the flange is positioned apart from an edge of the through-hole of the mounting panel while being closest to an edge of the through-hole without interfering with the edge of the through-hole.

In an aspect of the invention, the mounting panel may include a panel shroud extended from a position adjacent to the edge of the through-hole and covering the outer edge of the flange.

In an aspect of the invention, the flange of the axial flow fan may include a plurality of balancing protrusions regularly arranged into an annular form with a certain interval therebetween, so as to reduce vibration of the axial flow fan.

In an aspect of the invention, the fan shroud of the axial flow fan may include a plurality of balancing protrusions regularly arranged into an annular form with a certain interval therebetween, so as to reduce vibration of the axial flow fan.

In accordance with an alternative aspect of the present invention there is provided a fan assembly including a mounting panel with an air passage formed within the panel, and a fan located in the air passage. The fan includes a fan shroud connecting a plurality of fan blades, and a flange that extends radially from the fan shroud to a predetermined distance beyond the diameter of the air passage to reduce back flow.

BRIEF DESCRIPTION OF THE DRAWINGS

These and other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
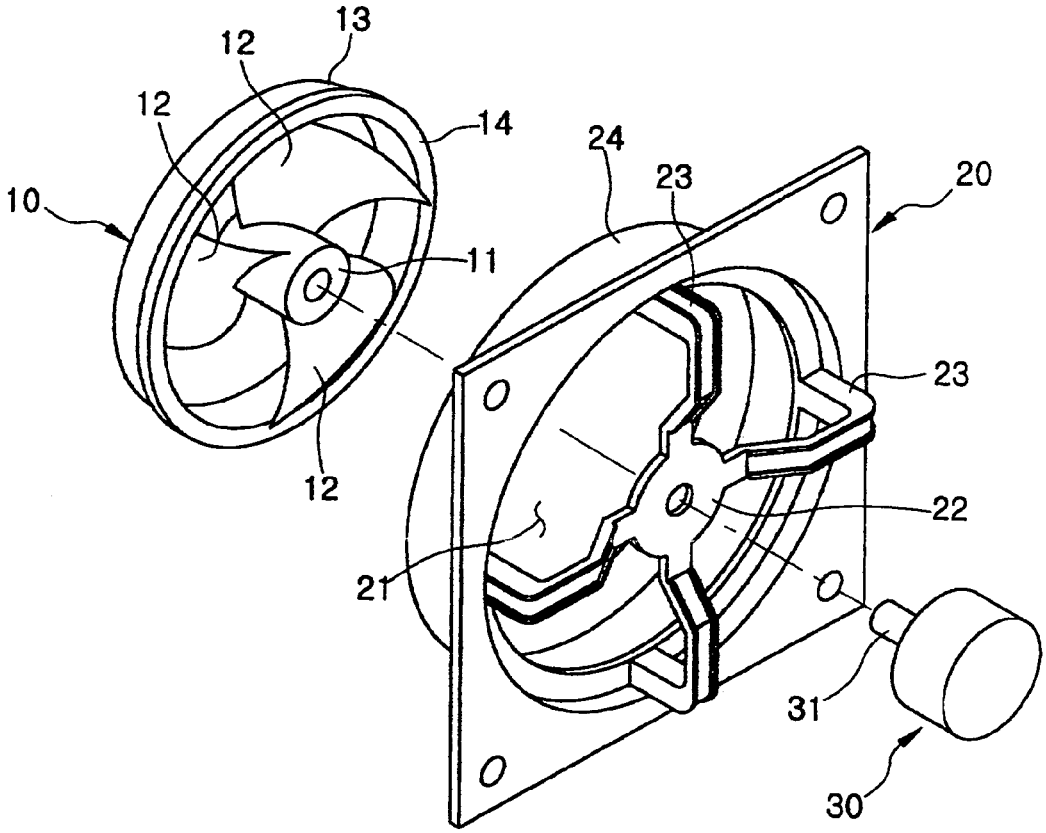
FIG. 1 is an exploded perspective view of an axial flow fan assembly, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
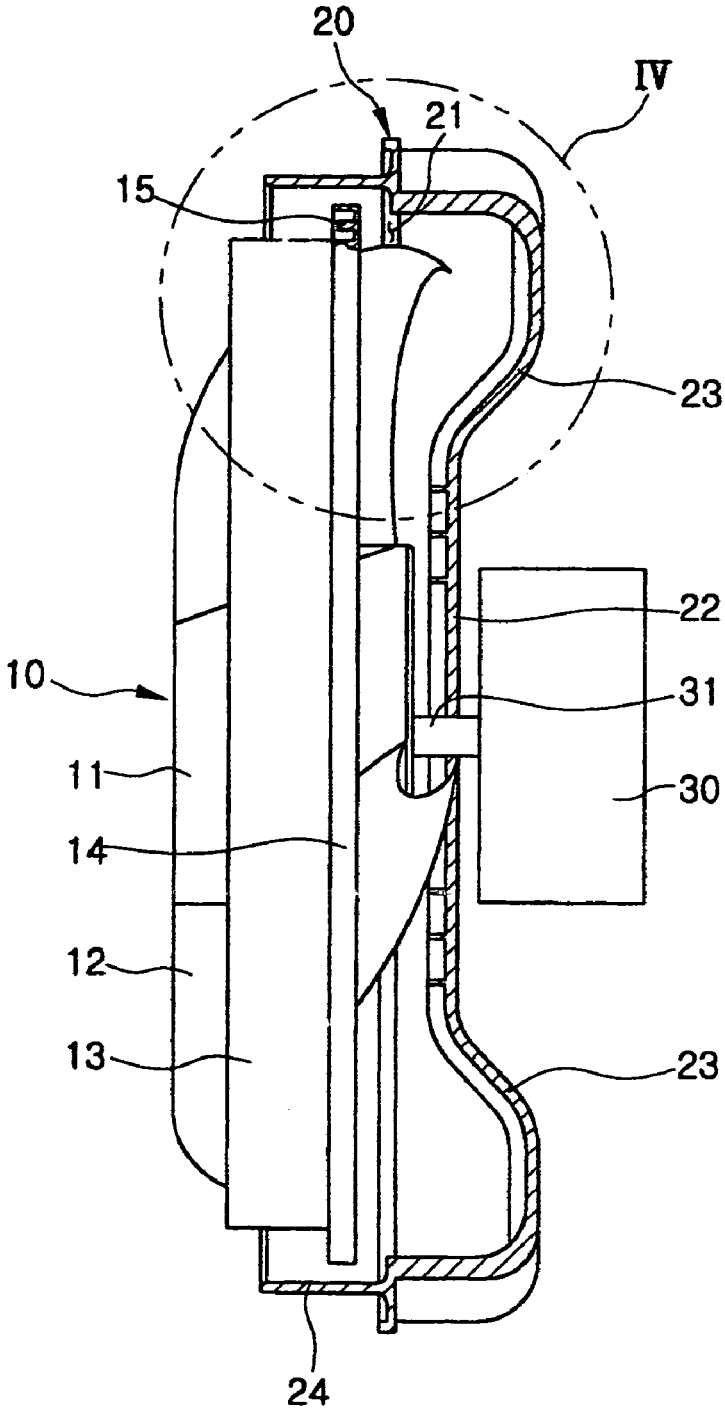
FIG. 2 is a cross-sectional view of the axial flow fan assembly shown in FIG. 1.

As shown in FIGS. 1 and 2, an axial flow fan assembly according to an embodiment of the present invention includes a drive motor 30 to generate a rotating force, an axial flow fan 10, which is rotated by the rotating force from the drive motor 30 to force fluid, such as air, to flow axially, and a mounting panel 20 to rotatably support the axial flow fan mounted thereon.

The mounting panel 20 includes a mounting seat 22 to allow the axial flow fan 10 and the drive motor 30 to be mounted thereon, and a plurality of support members 23 connected at one end thereof to the mounting seat 22 and connected at the other end to the panel body to position the mounting seat 22 at a predetermined location in a through-hole 21 or air passage. Accordingly, the axial flow fan 10 and the drive motor 30 are mounted on the mounting seat 22 in such a way that, the drive motor 30 is installed on a side of the mounting seat 22 such that a rotating shaft 31 of the drive motor 30 is inserted into the mounting seat 22, and the axial flow fan 10 is joined to the rotating shaft 31 of the drive motor 30.

The axial flow fan 10 includes a cylindrical boss 11, into which the rotating shaft 31 of the drive motor 30 is fitted, and a plurality of fan blades 12 integrally formed with an outer surface of the cylindrical boss 11 to draw air from the rear of the mounting panel 20 and to blow the air to the front.

The axial flow fan 10 further includes an annular fan shroud 13 to connect outer ends of the plurality of fan blades 12 to each other. The fan shroud 13 functions to maintain the fan blades 12 in its original shape over a long period of time as well as to guide air blown by the fan blades 12.

Furthermore, the fan shroud 13 includes an annular flange 14 radially extended from an outer surface thereof. The annular flange 14 is radially extended from the fan shroud to partially block a space between an inner surface of the through-hole 21 and the fan shroud 13, thereby diminishing the backflow of air passing through the annular space.

In this embodiment, the annular flange 14 of the fan shroud 13 is formed to have a diameter larger than that of the through-hole 21. Accordingly, when the axial flow fan 10 is normally mounted on the mounting seat 22, the annular flange 14 is positioned apart from a rear side of the mounting panel 20 while being closest to a circumferential edge of the through-hole 21 without interfering with the mounting panel 20, so as to minimize the air flow passing through the gap between the annular flange 14 and the circumferential edge of the through-hole 21.

The mounting panel 20 further includes a panel shroud 24 to surround the annular flange 14. The panel shroud 24 is radially extended from a portion adjacent to the edge of the through-hole 21 to have an annular form surrounding the annular flange 14. The panel shroud 24 is positioned to be closest to the annular flange 14 without contact with the annular flange 14, so as to minimize flow of air passing through the gap between the panel shroud 24 and the annular flange 14 while allowing the axial flow fan 10 to be freely rotated.

Accordingly, even though a suction force, generated at the rear of the axial flow fan 10, acts on the front of the axial flow fan 10, the flow of air passing through the gap defined between the annular flange 14 of the axial flow fan 10 and the panel shroud 24 and the edge of the through-hole 21 is minimized because the gap is considerably reduced.

Figure 3:
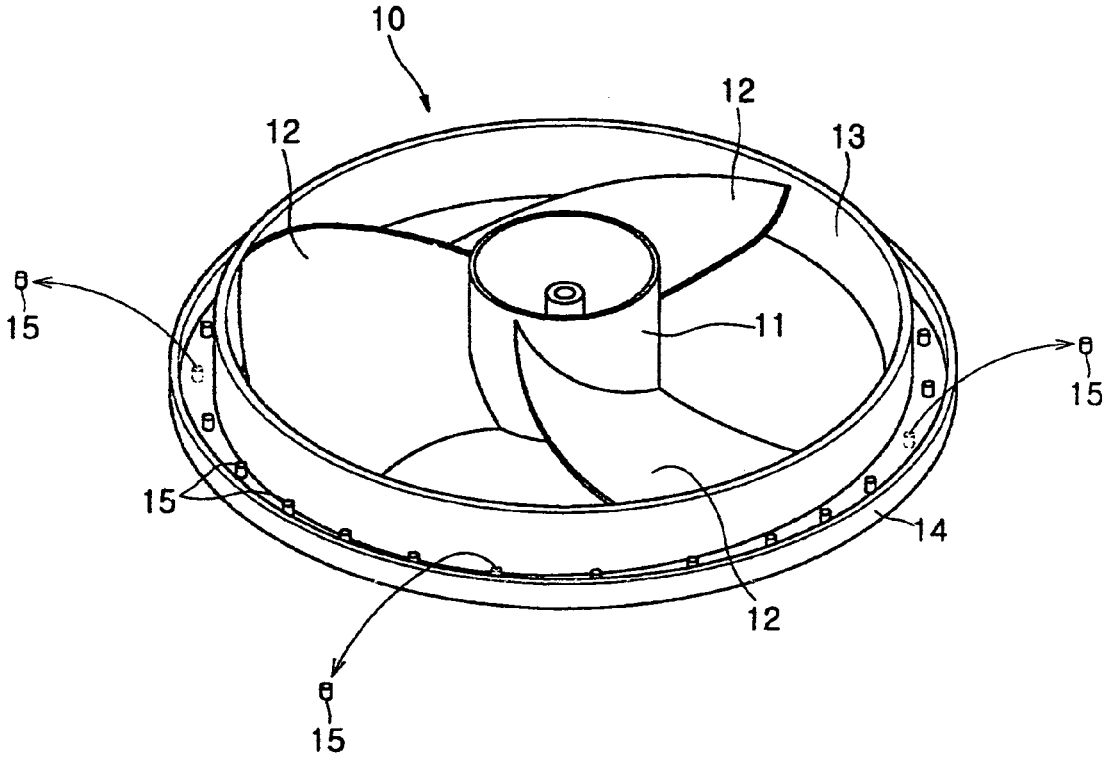
FIG. 3 is a perspective view of an axial flow fan shown in FIG. 1.

As shown in FIG. 2, the axial flow fan assembly according to another aspect of this embodiment of the present invention further includes a plurality of balancing protrusions 15 provided outside of the fan shroud 13 to allow vibration of the axial flow fan 10 to be easily reduced. The plurality of balancing protrusions 15 are integrally formed with the axial flow fan 10 by a process such as a molding. As shown in FIG. 3, the balancing protrusions 15 are regularly positioned at a certain interval to form an annular shape and provide small weights that may be removed to aid in balancing.

In this embodiment, the plurality of balancing protrusions 15 are axially extended from a rear side of the annular flange 14, and an outer circumferential edge of the annular flange 14 is rearwardly bent and extended to be parallel to the fan shroud 13, so as to cover the balancing protrusions 15. As a result of the bent portion of annular flange 14, it is possible to reduce turbulence in the air flow outside the fan shroud 13 from being created due to the balancing protrusions 15.

Accordingly, when vibration of the axial flow fan 10 is above a critical level, the vibration level of the axial flow fan 10 can be brought under control and reduced below the critical level by removing the balancing protrusions 15 one at a time.

In connection to this, if holes of a mold for producing the axial flow fan 10, which corresponds to the removed protrusions 15, are blocked, it is possible to produce a large number of axial flow fans 10 having virtually the same vibration level.

In this embodiment, although the balancing protrusions 15 are shown and described to be axially protruded from the annular flange 14, the balancing protrusions 15 are not limited to this and may extend axially and outwardly from the fan shroud.

An example operation and functions of the axial flow fan assembly according to an embodiment of the present invention will now be described.

In an assembling operation of the axial flow fan assembly, the axial flow fan 10 is installed in the through-hole 21 of the mounting panel 20 by firmly fitting the rotating shaft 31 of the drive motor 30 into the boss 11 of the axial flow fan 10. When electricity is supplied to the drive motor 30, the axial flow fan 10 rotates, and thus fluid, such as air, is drawn from the rear of the axial flow fan 10 to the front by a suction force generated by the axial flow fan 10. At this point, a portion of the suction force, generated at the rear of the axial flow fan 10, acts not only on the rear of the axial flow fan 10, but also on the front of the axial flow fan 10 through the gap between the axial flow fan 10 and the through-hole 21.

Figure 4:
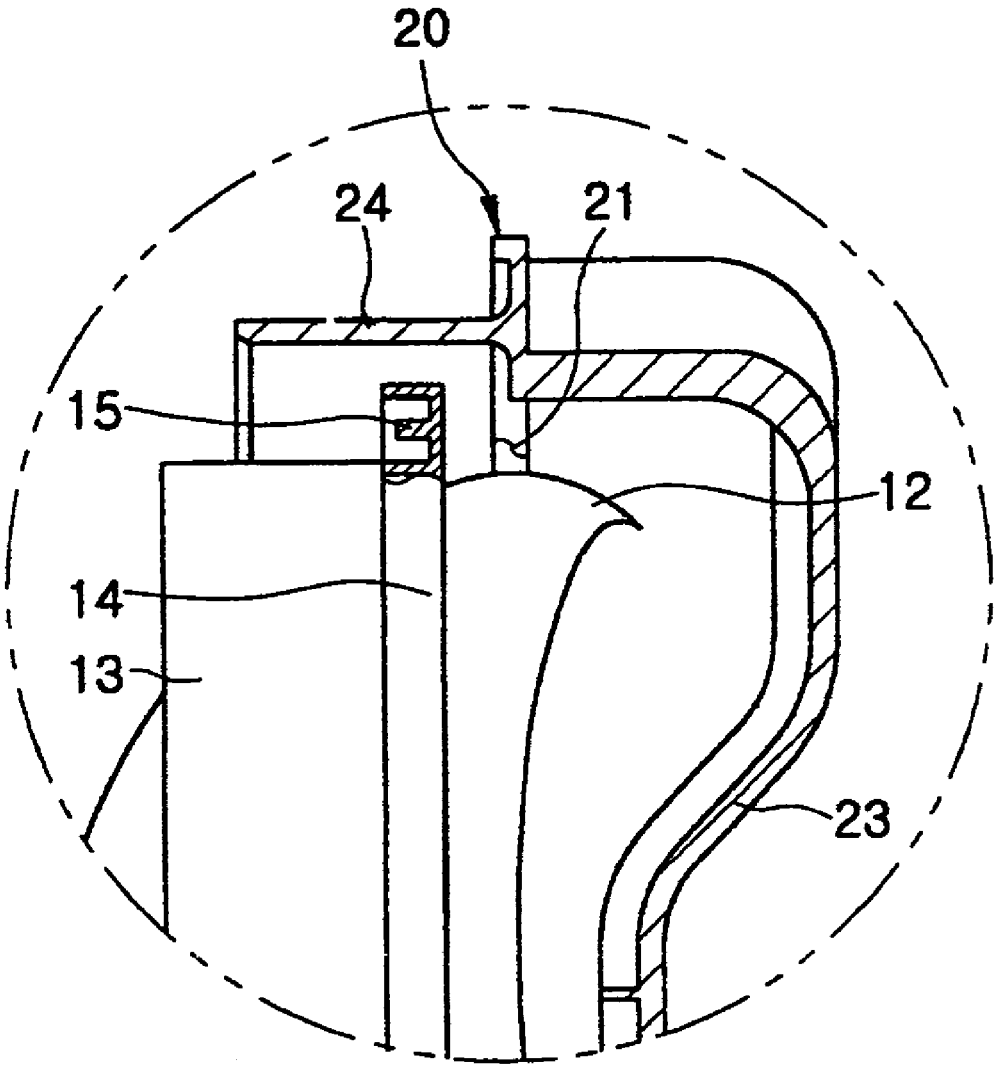
FIG. 4 is an enlarged cross-sectional view of a circle IV of FIG. 2.

Although the suction force acts on the front of the axial flow fan 10, the amount of air flowing from the front of the axial flow fan 10 to the rear of the axial flow fan 10 is considerably reduced. More specifically, since the path defined between the annular flange 14 and the fan shroud 13, and the inner edge of the through-hole 21 and the panel shroud 24, is greatly reduced and bent in a midstream thereof, as illustrated in FIG. 4, the flowing resistance of air passing through the path is increased, thereby suppressing the backflow of the air through the path.

In an assembling operation of the axial flow fan 10, the rotating shaft 31 of the drive motor 30 is first fitted into the boss 11 of the axial flow fan 10. The amount of vibration of the axial flow fan 10 is checked while the axial flow fan 10 is rotating. At this point, when the vibration level is above an optimum or desired level, the balancing protrusions 15 are arbitrarily removed one by one while repeatedly checking the amount of vibration until the vibration level reduces to the optimum level, as shown in FIG. 3. Accordingly, vibration of the axial flow fan 10 is easily reduced by sequentially removing the balancing protrusions 15 one by one.

As is apparent from the above description, the present invention provides an axial flow fan assembly, which includes an annular flange formed on an outer surface of a fan shroud to block a substantial portion of the gap between the fan shroud and a through-hole of a mounting panel, thereby decreasing the amount of air flowing backward through the gap.

In addition, the axial flow fan assembly according to the present invention can easily be adjusted to reduce vibration by selectively removing a plurality of balancing protrusions formed on the annular flange.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An axial flow fan assembly comprising:

a mounting panel having a through-hole to allow fluid to flow therethrough; and an axial flow fan including, a plurality of fan blades rotatably installed in the through-hole of the mounting panel to generate a suction force;

a fan shroud connecting outer ends of the plurality of fan blades to each other to guide the fluid flowing by the suction force;

a flange outwardly extended from the fan shroud to diminish the backflow of the fluid through a gap between the fan shroud and the through-hole of the mounting panel; and a plurality of balancing protrusions regularly arranged into an annular form with a certain interval therebetween, so as to reduce vibration of the axial flow fan, wherein the plurality of balancing protrusions are included in the flange of the axial flow fan.

2. The axial flow fan assembly as set forth in claim 1, wherein the flange has a diameter larger than that of the through-hole of the mounting panel to block the gap between the fan shroud and the through-hole of the mounting panel, and the flange is positioned apart from an edge of the through-hole of the mounting panel while being closest to an edge of the through-hole without interfering with the edge of the through-hole.

3. The axial flow fan assembly as set forth in claim 2, wherein the mounting panel includes a panel shroud extended from a position adjacent to the edge of the through-hole and covering the outer edge of the flange.

4. The axial flow fan assembly as set forth in claim 1, wherein the plurality of balancing protrusions are included in the fan shroud of the axial flow fan.

5. The axial flow fan assembly as set forth in claim 1, wherein an outer circumferential edge of the flange is rearwardly bent and extended to be parallel to the fan shroud.

6. The axial flow fan assembly as set forth in claim 1, wherein the balancing protrusions are individually removable.

7. A fan assembly comprising:

a mounting panel having an air passage formed within the panel;

a fan including a fan shroud connecting a plurality of fan blades, and a flange extending radially from the fan shroud to a predetermined distance beyond the diameter of the air passage, wherein the fan is located in the air passage; and a plurality of balancing weights to allow vibration of the fan to be easily reduced wherein the plurality of balancing weights are included in the fan shroud.

8. The fan assembly as in claim 7, wherein the plurality of balancing weights are included in the flange.

9. The fan assembly as in claim 7, wherein the mounting panel includes a panel shroud extending radially from the panel out beyond the outer edge of the flange.

10. The fan assembly as in claim 7, wherein an outer circumferential edge of the flange is rearwardly bent and extended to be parallel to the fan shroud.

11. The fan assembly as in claim 7, wherein the balancing weights are individually removable.

12. An axial flow fan assembly comprising:

a mounting panel having an annular panel shroud and having an air passage formed within the panel; and a fan located in the air passage, wherein the fan includes a fan shroud connecting a plurality of fan blades, and a flange extending radially from the fan shroud to a predetermined distance beyond the diameter of the air passage while remaining inside the annular panel shroud, wherein a plurality of balancing weights are included in the fan, the balancing weights being individually removable.

13. The axial flow fan assembly as in claim 12, wherein the plurality of balancing weights are disposed around the flange and extend from the surface of the flange while not extending beyond the outer edge of the flange.

14. The axial flow fan assembly as in claim 6, wherein the plurality of balancing weights are disposed around the fan shroud.

15. The axial flow fan assembly as in claim 12, wherein an outer circumferential edge of the flange is rearwardly bent and extended to be parallel to the fan shroud.

16. A fan assembly, comprising:

a mounting panel having a passage formed therein;

a fan including a plurality of fan blades, the fan being positioned in the passage;

a fan shroud surrounding the fan;

a flange extending radially from the fan shroud to a predetermined distance beyond the passage; and a plurality of balancing weights included in the fan shroud to allow vibration of the fan to be easily reduced.

* * * * *

UNITED STATES PATENT AND TRADEMARK OFFICE

CERTIFICATE OF CORRECTION

PATENT NO. : 7,025,570 B2
APPLICATION NO. : 10/747175
DATED : April 11, 2006
INVENTOR(S) : Sang Gyu Jung et al.

It is certified that error appears in the above-identified patent and that said Letters Patent is hereby corrected as shown below:

Column 6, Line 36 change “claim 6,” to --claim 12--.

Signed and Sealed this

First Day of May, 2007

JON W. DUDAS
*Director of the United States Patent and Trademark Office*